US006983847B2

(12) United States Patent
Fäller et al.

(10) Patent No.: US 6,983,847 B2
(45) Date of Patent: Jan. 10, 2006

(54) NEEDLE PACKAGING

(75) Inventors: Armin Fäller, Albstadt (DE); Artur Hoch, Albstadt (DE); Stefan Danner, Bitz (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/343,965

(22) PCT Filed: Jan. 23, 2002

(86) PCT No.: PCT/DE02/00220

§ 371 (c)(1),
(2), (4) Date: Feb. 6, 2003

(87) PCT Pub. No.: WO02/059016

PCT Pub. Date: Aug. 1, 2002

(65) Prior Publication Data

US 2003/0127349 A1 Jul. 10, 2003

(30) Foreign Application Priority Data

Jun. 24, 2001 (DE) ..... 101 03 130

(51) Int. Cl.
*B65D 85/24* (2006.01)

(52) U.S. Cl. ..... 206/757; 206/381; 206/784

(58) Field of Classification Search ..... 206/756, 206/757, 759, 760, 751, 754, 365, 380, 63.3, 206/784, 366

See application file for complete search history.

(56) References Cited

U.S. PATENT DOCUMENTS

| | | | | |
|---|---|---|---|---|
| 5,024,323 A * | 6/1991 | Bolton | ..... | 206/63.3 |
| 6,076,669 A * | 6/2000 | Ling | ..... | 206/349 |
| 6,371,300 B1 * | 4/2002 | Uchida | ..... | 206/751 |
| 6,619,476 B2 * | 9/2003 | Hoch et al. | ..... | 206/380 |

FOREIGN PATENT DOCUMENTS

| | | |
|---|---|---|
| DE | 2255158 | 5/1973 |
| DE | 93 07 034 U | 7/1993 |
| DE | 19646845 | 11/1996 |
| FR | 2 174 357 A | 10/1973 |
| GB | 2 174 366 A | 11/1986 |

* cited by examiner

*Primary Examiner*—Jacob K. Ackun, Jr.
(74) *Attorney, Agent, or Firm*—Venable LLP; Ralph P. Albrecht; Stuart I. Smith

(57) ABSTRACT

A needle package (1), particularly for packaging needles (N), has a hold-down device (23) that is disposed in an interior space (I) and serves to secure the needles (N) in the interior space (I). The hold-down device (23) is formed, for example, by one or two resilient elements, such as clamping lips (24, 25), which extend transversely to the needles (N) through the interior space (I). The clamping lips (24, 25) are disposed on the inside of a segment of the package (1) that is moved toward the needles (N) after the package has been filled, so the clamping lips (24, 25) rest against the needles (N). The segment can be formed, for example, by a lid segment (12) that is seated to pivot on the receiving area (3) of the package (1). This package can be filled particularly simply, and is suitable for various types of needles.

12 Claims, 3 Drawing Sheets

NEEDLE PACKAGING

Figure 1:
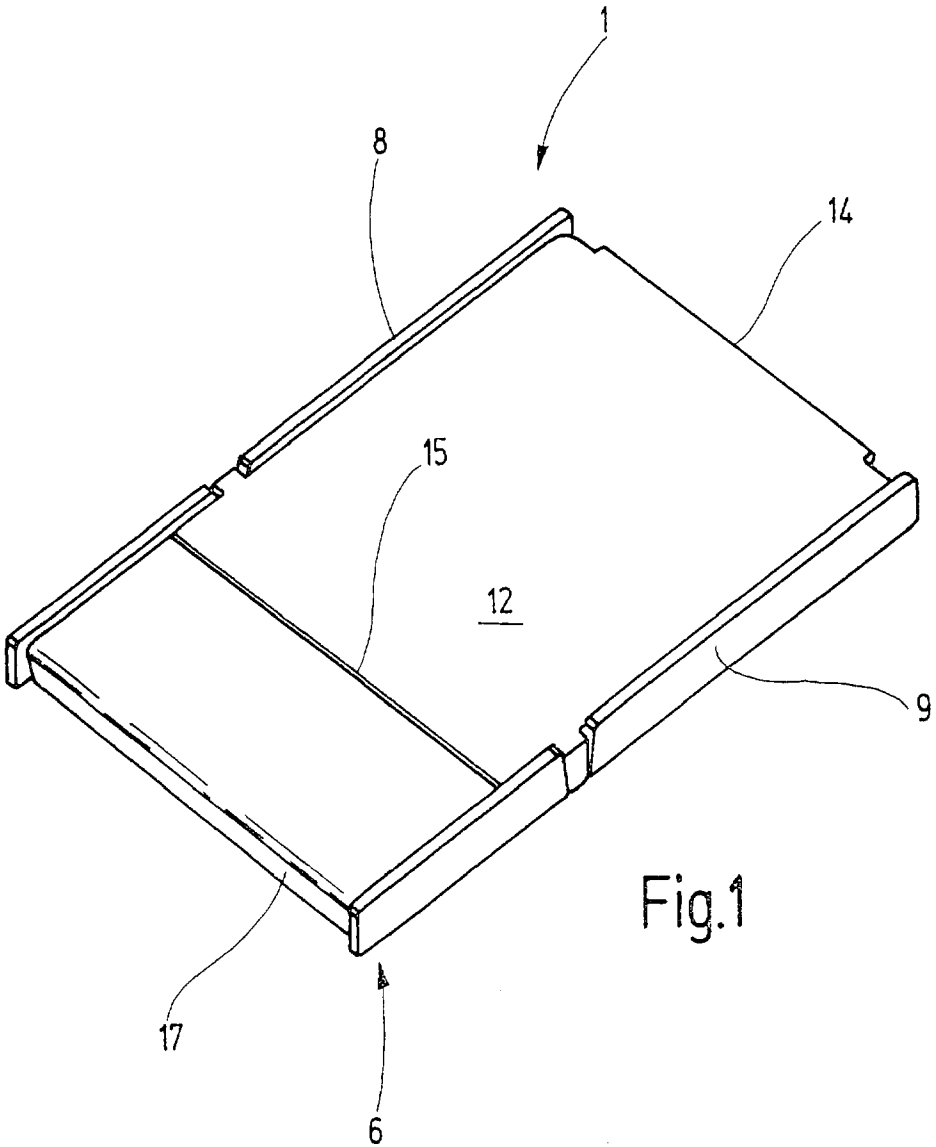

The invention relates to a package, particularly for sewing-machine needles or other oblong items.

Producers of oblong parts, such as machine parts, sewing-machine needles or other oblong elements, must often package their products in packages in which the products are held in an ordered manner, and from which they can be removed easily as needed. From the point of view of the manufacturer, the packages should be as simple as possible to fill. Larger production lines may incorporate packaging machines. Smaller lines typically employ manual packaging. Accordingly, the package that can be filled as simply as possible must be selected. The producer must also consider that different parts can be packaged together, so it may not be necessary to provide different packages for an assortment of similar items.

DE 196 46 845 C1 discloses a needle package having a one-piece casing body, which can be closed to form a flat, rectangular package. In this state, the casing body encloses an interior space for receiving straight or curved sewing-machine needles. For housing the needles neatly, longitudinal or curved webs are provided adjacently in the interior space, and separate the needles.

The webs occupy space that is then not available for the needles. Moreover, they have a needle-specific embodiment; that is, different webs must be provided for straight and curved needles. This may stipulate the provision of different packages.

DE-OS 22 55 158 discloses a needle package that is constructed on a cardboard backing. An oblong plastic carrier disposed on the backing is in turn covered by a transparent plastic part. A web of the quadrilateral carrier encompasses a felt strip having oblong, slot-like openings on its outside and inside. The sewing needles are inserted through these openings, and thus through the felt strip, and are fixed in place by the felt strip.

This type of package is costly and difficult to fill.

In view of this, it is the object of the invention to create a package that has multiple uses and is easy to handle.

This object is accomplished with the package according to claim 1:

The package according to the invention has a casing body, which surrounds an interior space for receiving the elements to be packaged. A hold-down device embodied on the casing body serves to secure the packaged elements in the interior space. For example, the hold-down element presses the elements against a rear wall of the casing body, so the elements do not rattle. Thus, the elements are housed neatly and can be removed from the package easily.

Because the hold-down device is embodied on the casing body, it need not be handled separately when the package is closed. For example, the package can be configured to include a receiving part that is securely closed by a first cover after the package has been filled. This lid is not opened when the elements are removed—it remains closed. Only a removal opening is opened. The hold-down device is preferably disposed in the region of the lid that is closed when the package is initially filled, that is, at or opposite the lid. Thus, the elements to be packaged are automatically clamped securely when the package is closed, without necessitating a special handle or other separate measure. The package is therefore very easy to handle and fill, the parts can be removed easily and the package can be used for different types of elements. Furthermore, the hold-down device preferably does not make contact between the oblong elements, so they can be packaged adjacently and touching one another. This permits a good utilization of the package volume.

The casing body of the package is preferably embodied in one piece. For example, it can be a plastic injection-molded part. If necessary, however, it is also possible to produce the package in multiple parts, for example with the receiving area and the lid part being produced separately and latched together after the receiving area has been filled. The key advantage of this alternative embodiment is also the hold-down device, which is formed onto one or both of the package parts, so the oblong machine elements are clamped when the package is filled. It is also possible to produce the hold-down device separately and attach it to the casing body later, e.g., with glue.

The hold-down device has at least one deformable segment; the deformation may be plastic, elastic or a mixture of plastic and elastic. The advantage of an at least somewhat elastic component is that individual elements can be removed from the package and re-inserted into it, if need be, then held in an elastic manner (clamped) again.

The hold-down device is formed by, for example, one or more projections embodied on the flat sides of the package. The projection is flexible so that it can press the oblong machine element against the oppositely-located flat side or contact points. The projections are more flexible than the rest of the casing body, so the hold-down device, but not the casing body, is deformed when the package is closed.

The package is preferably provided at one end with a removal opening, which can be closed by a sealing flap. The hold-down device is preferably disposed outside of the region of the casing body that is occupied by the sealing flap. The advantage of this arrangement is that the packaged elements can be held flexibly in the interior space, even if the package is open and they can be removed from it.

The removal opening preferably extends over the entire width of the package, so when the package is open, all of the elements are exposed and one or more may be removed as needed. The sealing flap can be embodied in one or more parts. The sealing flap can also have an associated, pivoting receiving segment to improve access to the ends of the packaged elements.

The hold-down device can be embodied in one piece with the package, and formed by one or more resilient clamping lips, which are disposed in a row or parallel and extend transversely through the interior space, and therefore transversely to the opening direction of the removal opening, preferably over the entire width of the package. The hold-down device therefore securely holds all of the elements inserted into the interior space, regardless of their concrete shape. For example, one type of needle, or both straight and curved sewing-machine needles, can be packaged together. Needles of different sizes can also be packaged together.

The hold-down device preferably comprises two clamping lips, which are oriented in the same direction or in opposite directions, and are inclined toward the flat side of the package.

Further details of advantageous embodiments of the invention ensue from the drawing, the description and the dependent claims.

Figure 2:
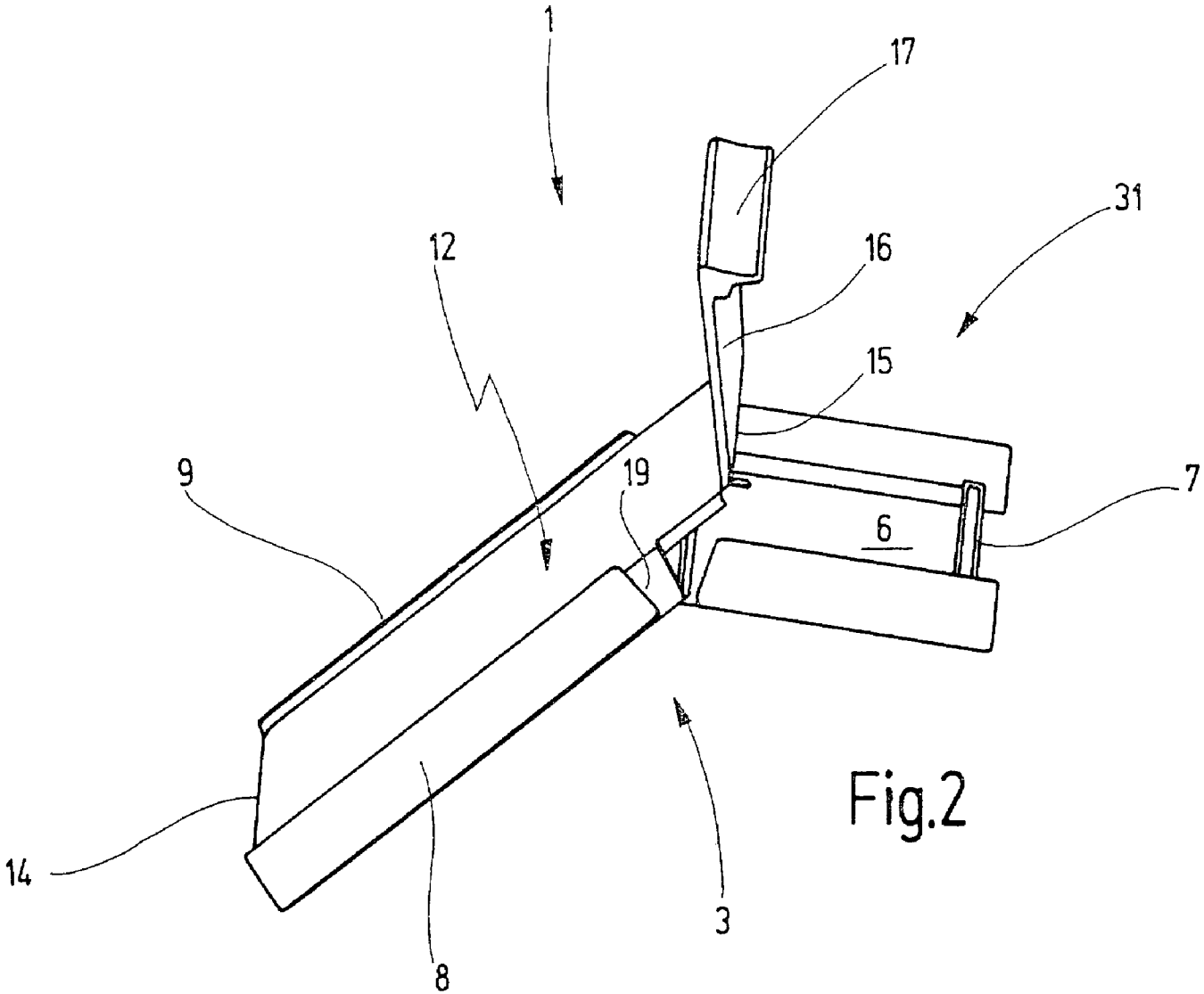
Figure 3:
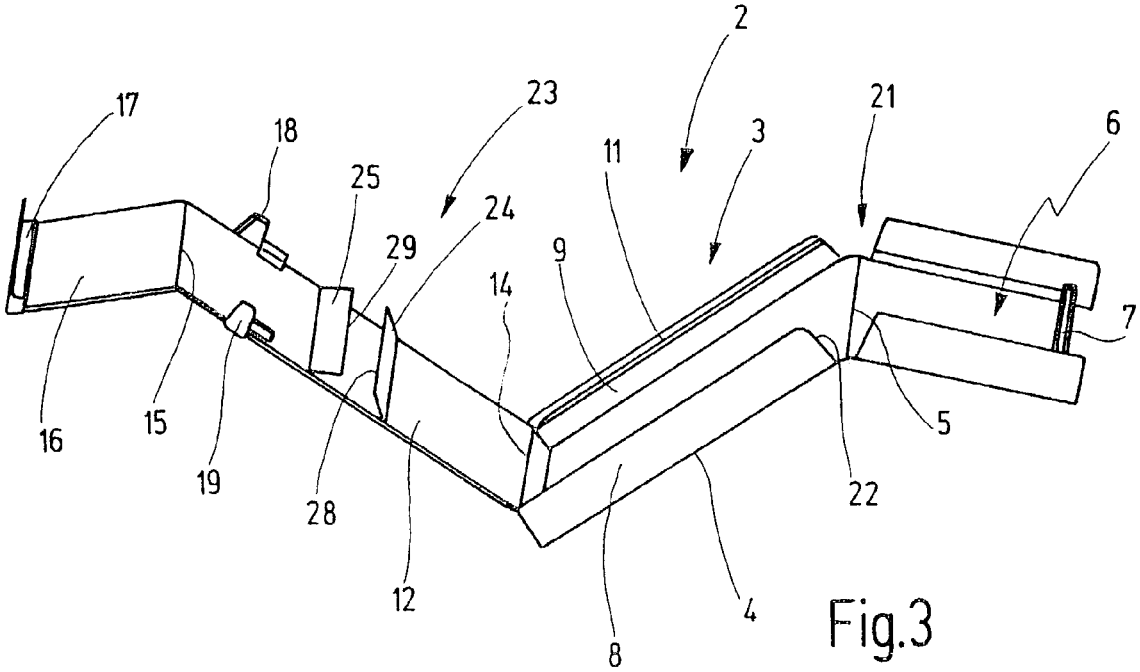
Figure 4:
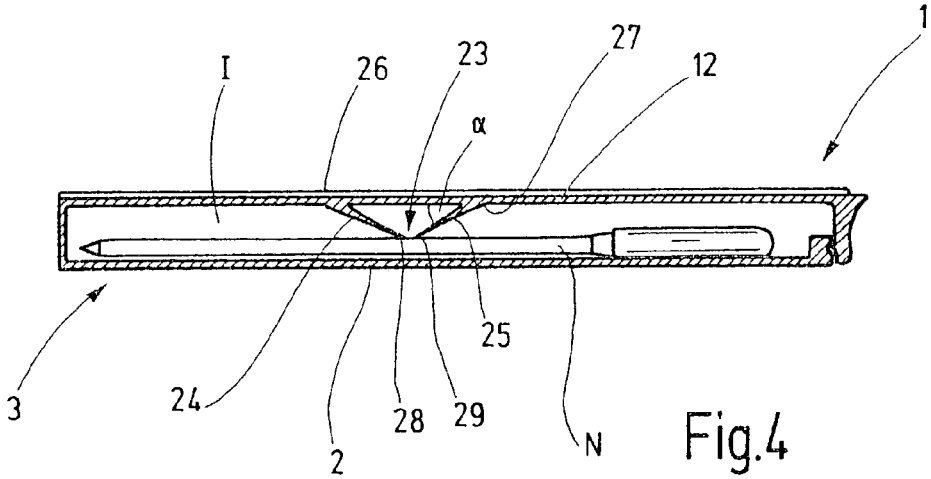

The drawing illustrates an exemplary embodiment of the invention. Shown are in:

FIG. 1 a needle package in the closed state;

FIG. 2 a perspective view of the package according to FIG. 1, with the sealing flap open;

FIG. 3 the casing body of the package in the open state, prior to filling; and FIG. 4 a sectional side view of the closed package, on a different scale.

FIG. 1 illustrates a needle package 1, which supplies a plurality of sewing-machine needles N (FIG. 4). The needle package 1 has a one-piece casing body 2, which is preferably a plastic injection-molded part (FIG. 3). The casing body is subdivided into a rectangular, flat receiving area 3, which is relatively rigid and is bordered on three sides by an edge 4. A receiving segment 6, which supports a latching tab 7 at its end, adjoins the receiving area 3 by way of a live hinge 5. The edge 4 continues along the receiving segment 6.

Side walls 8, 9, which make up part of the edge 4 and extend parallel to and opposite one another, are provided on the inside with a latching notch 11 that serves in securely receiving a rigid, rectangular lid segment 12. A live hinge 14 connects this lid segment to an end of the edge 4 that is located opposite the latching tab 7, and is approximately level with the latching notch 11. A further live hinge 15 is provided parallel to the live hinge 14; it connects a sealing-flap segment 16 having a wide catch 17 to the lid segment 12. Projections 18, 19 may be provided on the lid segment 12, in the vicinity of the live hinge 15; these extend into corresponding gaps 21, 22 of the side walls 8, 9.

A hold-down device 23 is embodied on the lid segment 12 (FIG. 3). As shown in FIG. 4, this device serves to clamp the sewing-machine needles N in the interior space I surrounded by the casing body 2. The hold-down device 23 has a deformable segment. In the illustrated embodiment, this segment is formed by two clamping lips 24, 25, which extend from the side wall 8 to the side wall 9. As can be seen in FIG. 4, the clamping lips are connected in one piece to the lid segment 12. The lid segment 12 and the clamping lips 24, 25 can be produced from the same material as the casing body 2. They form an angle $\alpha$ of about 45° with the planar lid segment 12. They are thickest at their transition points 26, 27, where they change over into the lid segment 12. From there, they taper toward their straight front edges 28, 29. The front edges 28, 29 are disposed parallel to the transition points 26, 27 and to one another, and point toward one another. The clamping lips 24, 25 are flexible: Although they are planar in the relaxed state, they may assume a wavy shape when they rest against the needles N. The front edges 28, 29 are also wavy in this case. Otherwise, the clamping lips 24, 25 yield somewhat, so the spring force exerted by the contact with the needles N is reliably absorbed by the latching connection between the lid segment 12 and the latching notches 11 provided in the side walls 8, 9.

The needle package 1 described to this point is filled as follows:

First, the casing body 2 is produced in accordance with FIG. 3. For filling the body with needles N, the needles are inserted into the receiving area 3 when the casing body 2 is open (FIG. 3). Afterward, the casing body 2 is closed: The lid segment 12 is folded over the receiving area 3 and latched with it, as can be seen in FIG. 4. The clamping lips 24, 25 rest against the needles N, and press them against the bottom of the receiving area 3. The needles N thus rest securely and immovably in the interior space I, and are held in place. The hold-down device 23 need not be handled separately.

When individual needles N are to be removed, the needle package 1 is opened, as shown in FIG. 2. In the process, the sealing-flap segment 16 is moved away from the receiving segment 6. The receiving segment 6 can also be folded away from the sealing-flap segment 16. This exposes a slot-like removal opening 31, from which the sealing-flap segment 16 and the receiving segment 6 extend in a Y shape. The interior space I and the removal opening 32 have matching widths. The ends of the needles N protrude from the removal opening 31, with the clamping lips 24, 25 securely holding the needles N in the interior space. The needles N can now be removed individually; the removal of one needle N does not affect the other needles. The elasticity of the clamping lips 24, 25 ensures that the needles are even held securely in the interior I if some of the needles N have already been removed from the needle package 1.

The needle package 1 can be re-closed at any time when the receiving segment 6 and the sealing-flap 16 are returned from the position shown in FIG. 2 to the position shown in FIG. 1. Needles N that have already been removed can also be re-inserted into the interior space I of needle package 1 through the removal opening 31.

In modified embodiments, only one clamping lip 24, or a plurality of clamping lips (three, four or more) can be provided. Also, the clamping lips 24, 25 may alternatively be supplemented or replaced by corresponding clamping lips on the bottom of the receiving area 3. The clamping lips 24, 25 may, as shown in FIG. 4, be oriented diagonally relative to one another. It is also possible to orient the clamping lips in the same direction, as is the case for the clamping lips 25. The advantage of this arrangement is that needles can be re-inserted into the needle package without being impeded by a clamping lip. The hold-down device 23 can also be produced from a material other than that of the casing body 2, if necessary. For example, the device may be formed by a foam-rubber strip attached to the lid segment 12.

A needle package 1, particularly for packaging needles N, has a hold-down device 23 that is disposed in an interior space I and serves to secure the needles N in the interior space I. The hold-down device 23 is formed, for example, by one or two resilient elements, such as clamping lips 24, 25, which extend transversely to the needles N through the interior space I. The clamping lips 24, 25 are disposed on the inside of a segment of the package 1 that is moved toward the needles N after the package has been filled, so the clamping lips 24, 25 rest against the needles N. The segment can be formed, for example, by a lid segment 12 that is seated to pivot on the receiving area 3 of the package 1. This package can be filled particularly simply, and is suitable for various types of needles.

REFERENCE CHARACTERS

| | |
|---|---|
| 1. | Needle package |
| 2. | Casing body |
| 3. | Receiving area |
| 4. | Edge |
| 5. | Live hinge |
| 6. | Receiving segment |
| 7. | Latching tab |
| 8. | Side wall |
| 9. | Side wall |
| 10. | |
| 11. | Latching notch |
| 12. | Lid segment |
| 13. | |
| 14. | Live hinge |
| 15. | Live hinge |
| 16. | Sealing-flap segment |
| 17. | Catch |
| 18. | Projection |
| 19. | Projection |
| 20. | |
| 21. | Gap |
| 22. | Gap |
| 23. | Hold-down device |

-continued

| REFERENCE CHARACTERS | |
|---|---|
| 24. | Clamping lip |
| 25. | Clamping lip |
| 26. | Transition point |
| 27. | Transition point |
| 28. | Front edge |
| 29. | Front edge |
| 30. | |
| 31. | Removal opening |

I = Interior space
N = Sewing-machine needle

What is claimed is:

1. A package comprising:

a casing body that surrounds an interior space and has a substantially flat lid segment, the casing body and lid segment being a one-piece, plastic injection-molded part;

a plurality of needles removably received in the casing body; and at least one deformable clamping lip provided on the lid segment, the clamping lip projecting into the interior space and forming an acute angle with the lid segment when the lid segment is in a closed position and when the clamping lip is in a relaxed unused state, the clamping lip being for holding the plurality of needles when the lid segment is in the closed position.

2. The package according to claim 1, wherein the casing body and the clamping lip are connected to one another as one piece.

3. The package according to claim 1, wherein the deformable clamping lip is elastically deformable.

4. The package according to claim 1, wherein the casing body has two flat sides, which border the interior space on opposite sides, and the clamping lip is formed by at least one projection that extends from one of the flat sides.

5. The package according to claim 1, wherein the casing body has a removal opening at one end, and the removal opening has at least one associated sealing flap.

6. The package according to claim 5, wherein the removal opening has an opening direction, and the at least one clamping lip extends transversely relative to the opening direction.

7. The package according to claim 1, wherein the clamping lip extends over at least part of the width of the interior space.

8. The package according to claim 1, wherein the clamping lip decreases in thickness from an attachment point to its free end.

9. The package according to claim 1, wherein the clamping lip is connected to a flat lid segment of the casing body.

10. The package according to claim 9, wherein the clamping lip is connected to a flat lid segment of the casing body, and is oriented toward a removal opening.

11. The package according to claim 1, further comprising two clamping lips, the clamping lips pointing toward one another on a diagonal.

12. The package according to claim 1, further comprising two clamping lips that point in the same direction.

* * * * *